US005515970A

United States Patent [19]

Ritchie et al.

[11] Patent Number: 5,515,970

[45] Date of Patent: May 14, 1996

[54] LIGHT-TIGHT PACKAGE

[75] Inventors: Shawn W. Ritchie; Michael L. Koelsch, both of Rochester; Charles E. Young, Williamson, all of N.Y.

[73] Assignee: Eastman Kodak Company, Rochester, N.Y.

[21] Appl. No.: 376,571

[22] Filed: Jan. 23, 1995

[51] Int. Cl.[6] ..... B65D 85/671

[52] U.S. Cl. ..... 206/397; 206/398; 206/410; 206/414; 206/416

[58] Field of Search ..... 206/316.1, 389, 206/397, 398, 400, 407, 410, 411–416

[56] References Cited

U.S. PATENT DOCUMENTS

| | | | |
|---|---|---|---|
| 4,148,395 | 4/1979 | Syracuse et al. | 206/414 |
| 4,505,387 | 3/1985 | Seto | 206/414 |
| 4,733,777 | 3/1988 | VanGeyte et al. | 206/316 |
| 4,911,299 | 3/1990 | Peeters | 206/410 |
| 5,133,171 | 7/1992 | Chase et al. | 53/409 |
| 5,174,095 | 12/1992 | Fujiwara et al. | 53/480 |
| 5,222,601 | 6/1993 | Takahashi et al. | 206/416 |
| 5,353,933 | 10/1994 | Takahashi et al. | 206/413 |
| 5,452,797 | 9/1995 | Pollard | 206/416 |

FOREIGN PATENT DOCUMENTS

| | | |
|---|---|---|
| 2124969 | 12/1994 | Canada . |
| 0488738 | 11/1991 | European Pat. Off. . |
| 586409 | 10/1933 | Germany . |

OTHER PUBLICATIONS

Research Disclosure, May 1983, #22932, Roll Package, disclosed by H. Cornelissen and D. Peeters.

*Primary Examiner*—Jimmy G. Foster
*Attorney, Agent, or Firm*—Charles E. Snee, III

[57] ABSTRACT

An improved light-tight package for a roll (10) of a length (14) light-sensitive material such as photographic film or paper includes an opaque leader (22) wound around the roll. Folded-over portions (48, 50) of opaque end disks (32, 34) are held in place by adhesive tape strips (44, 46). Upon unrolling one embodiment of the package by pulling the leader, the end disks release from the adhesive strips without tearing; and the adhesive strips remain attached to the leader and are removed from the roll with the leader. Upon unrolling another embodiment, the end disks tear circumferentially and the torn-away portions are removed with the tape strips and the leader.

8 Claims, 2 Drawing Sheets

LIGHT-TIGHT PACKAGE

DESCRIPTION

1. Technical Field

The invention concerns packages for rolls of web material. More particularly, the invention concerns a light-tight package suitable for use with sensitized goods such as rolls of photographic paper and film.

2. Background Art

Currently rolls of photographic film and paper are packaged in several different ways to facilitate room light loading into cooperating apparatus which dispenses or otherwise uses the film or paper. Commonly assigned U.S. Pat. No. 4,148,395 discloses a package which includes a pair of flexible opaque end disks or covers attached to the ends of the core of the roll and an opaque leader attached to the leading end of the length of film or paper forming the roll. A peripheral portion on each end disk is folded over and adhered to the edge of an underlying convolution of the leader. A layer of adhesive is provided on the underside of peripheral portion prior to folding over. When the leader is pulled away from the packaged roll, the end disks tear circumferentially at the edge of the roll; so that, the peripheral portions remain adhered to the leader. However, since the folded over portions tend to crimp or fold unevenly, passages for light tend to be formed between the folded over portions and the leader, which can allow light to reach and damage the film or paper.

Commonly assigned U.S. Pat. No. 5,133,171 discloses a package which includes a pair of similar end disks and a leader. After a first convolution of the leader is wrapped onto the roll, peripheral portions of the end disks are folded over the first convolution. A second convolution is then wrapped onto the roll to capture the folded-over peripheral portions between the first and second convolutions and to make the package light tight. Friction is relied upon to retain the folded-over portions between the convolutions of leader and no adhesive is used. However, the frictional engagement between the folded-over portions and the convolutions of the leader occasionally is not sufficient to prevent the folded-over portions from slipping at least partially free, thereby permitting entry of light and damage to the product. The requirement for a second full convolution also adds expense to the product and produces additional waste material for the customer.

Research Disclosure No. 22932 of May 1993 shows a package in which the end disks have the same diameter as the roll. A strip of adhesive tape is wrapped around each of the circumferential edges of an outer convolution of the leader and then folded over onto the end disk. The folded over portions of the tape strips tend to crimp or fold unevenly, so that passages for light tend to be formed between the folded over portions and the end disks, which can allow light to reach and damage the film or paper. Extra components, such as an enclosing bag, may be necessary to ensure light tightness.

SUMMARY OF THE INVENTION

The primary objective of our invention is to provide an improved light-tight package which remains properly closed until opened during room light loading.

Another objective of our invention is to provide such a package whose elements do not interfere with dispensing of the product after opening of the package.

A still further objective of our invention is to provide such a package in which no adhesive remains near the roll after opening of the package, thereby preventing contamination of the edges of the product or the cooperating apparatus with adhesive.

Still another objective of our invention is to provide such a package in which a reduced length of leader is needed for light tightness.

These objectives are given only by way of illustrative examples; thus other desirable objectives and advantages inherently achieved by our invention may occur or become apparent to those skilled in the art. Nonetheless, the scope of our invention is to be limited only by the appended claims.

Our invention is defined by the appended claims. A light-tight package according to our invention is particularly useful for a roll of light-sensitive web material which includes a core with opposite ends and a length of the web wound about the core, the roll having end surfaces at the opposite ends of the core and the length having a first width and a leading end. A flexible opaque leader is wound about the roll through at least a first convolution. The leader has a trailing end attached to the leading end of the web, a second width substantially equal to the first width, an outer surface, a length greater than a maximum circumference of the roll and opposite lateral edges separated by the second width. A pair of flexible opaque end disks cover the end surfaces, a central portion of each end disk being attached to the core and a peripheral portion of each end disk being folded over a circumferential edge of the first convolution of the leader, each folded over portion having an outer surface and a circumferential edge. In accordance with our invention, at least one strip of adhesive tape is adhered to the outer surface of each of the folded over peripheral portions and to the adjacent outer surface of the leader.

The at least one strip of adhesive tape preferably extends over the folded over portions but does not extend axially beyond the circumferential edges of the leader. This ensures that when the package is opened, the strip will move away from the roll with essentially the entire adhesive side of the strip faced to the leader and not exposed to the product or surrounding components of the cartridge or other equipment. A single strip may be used to secure both folded over portions; however, two strips of the adhesive tape are preferred for wider rolls, one for each folded over portion. To prevent inadvertent exposure of the product upon opening the package, the leader may have a length of at least one and one-eighth times the circumference of the roll. An additional length of leader may be provided for grasping by the customer. Each lateral edge of the leader preferably includes a feature extending inwardly toward a center line of the leader, the features being spaced from the trailing end by a distance substantially equal to one and one-eighth times the circumference of the roll, thereby providing clearance for any further convolution of the leader to pass the folded over peripheral portions of the end disks. The at least one strip of adhesive tape preferably is continuous but may be made up of several portions extending around the roll.

The end disks may be made from a material having sufficient tensile strength to resist tearing before the at least one strip releases the folded-over portions, whereby upon unrolling of the package by pulling the leader, the end disks release from the at least one strip without tearing and the at least one strip moves away from the roll with the leader. Alternatively, the end disks may be made from a material having sufficient tensile strength to allow tearing before the at least one strip releases the folded-over portions, whereby upon unrolling of the package by pulling the leader, the end disks tear circumferentially and the at least one strip and the torn away, folded over portions move away from the roll with the leader.

A package according to our invention provides important advantages over prior art packages. The use of adhesive strips having the properties just described ensures that the end disks will remain securely attached to the leader to provide a light-tight package before the package must be opened. When a roll wrapped in accordance with our invention is placed in a cassette or other cooperating apparatus and the strip of leader is removed to open the package, the adhesive elements remain with the leader. This is because the end disks either release and peel away from the adhesive strips, or tear circumferentially, as the leader and adhesive strips are pulled away. Since the adhesive elements remain on the leader, there is no opportunity for contamination of the product by the adhesive. The pull force to remove the leader is not increased substantially over that of prior art packages. Once the leader is removed, because the end disks are flimsy, they tend to unfold away from the roll to facilitate dispensing of the product and do not interfere with the dispensing or with the structure of the cooperating cassette or other apparatus. A much shorter leader is needed than with prior art packages since a second, full convolution of leader is not required for light tightness.

BRIEF DESCRIPTION OF THE DRAWINGS

The foregoing and other objectives, features and advantages of the invention will be apparent from the following more particular description of the preferred embodiments of the invention, as illustrated in the accompanying drawings.

DESCRIPTION OF THE PREFERRED EMBODIMENTS

Figure 1:
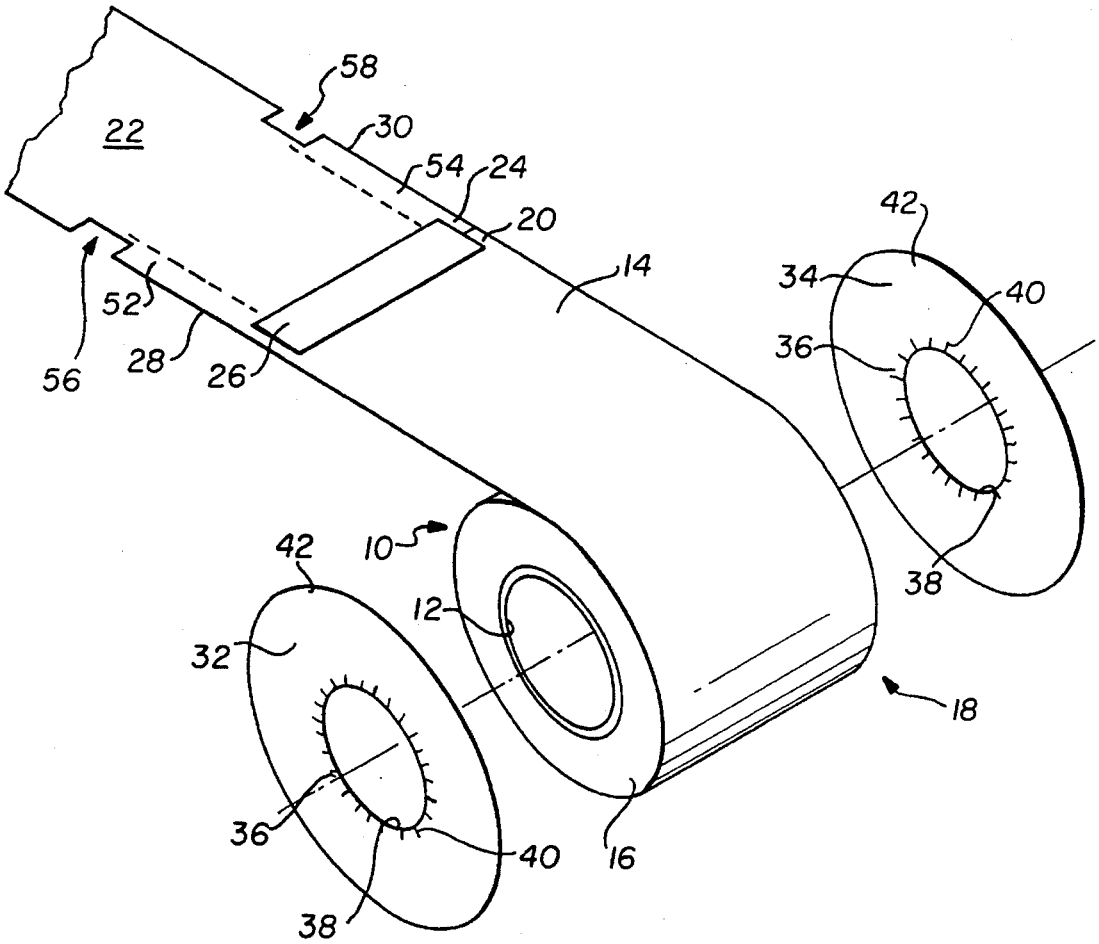
FIG. 1 illustrates schematically a perspective, exploded view of a roll of web material with a leader attached to the leading edge of the web and two unattached end disks.

The following is a detailed description of the preferred embodiments of the invention, reference being made to the drawings in which the same reference numerals identify the same elements of structure in each of the several Figures.

Figure 2:
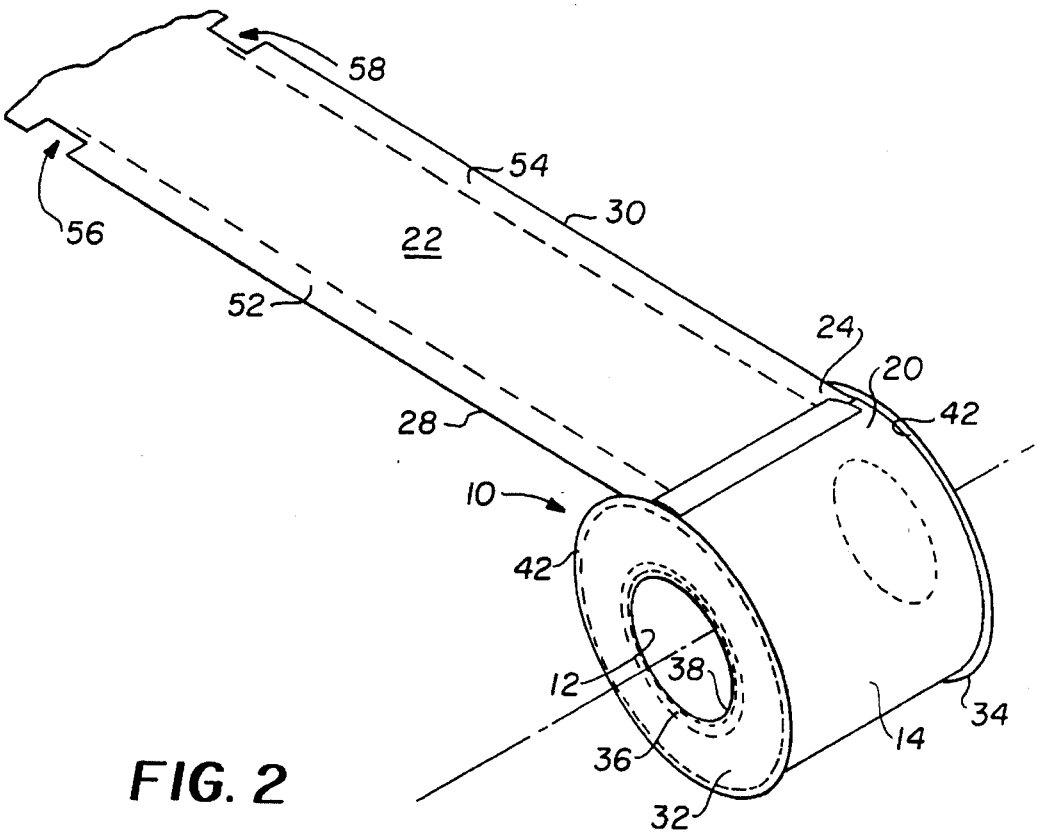
FIGS. 2 and 3 illustrate schematically perspective views of our package as it passes through sequential steps of assembly.
Figure 3:
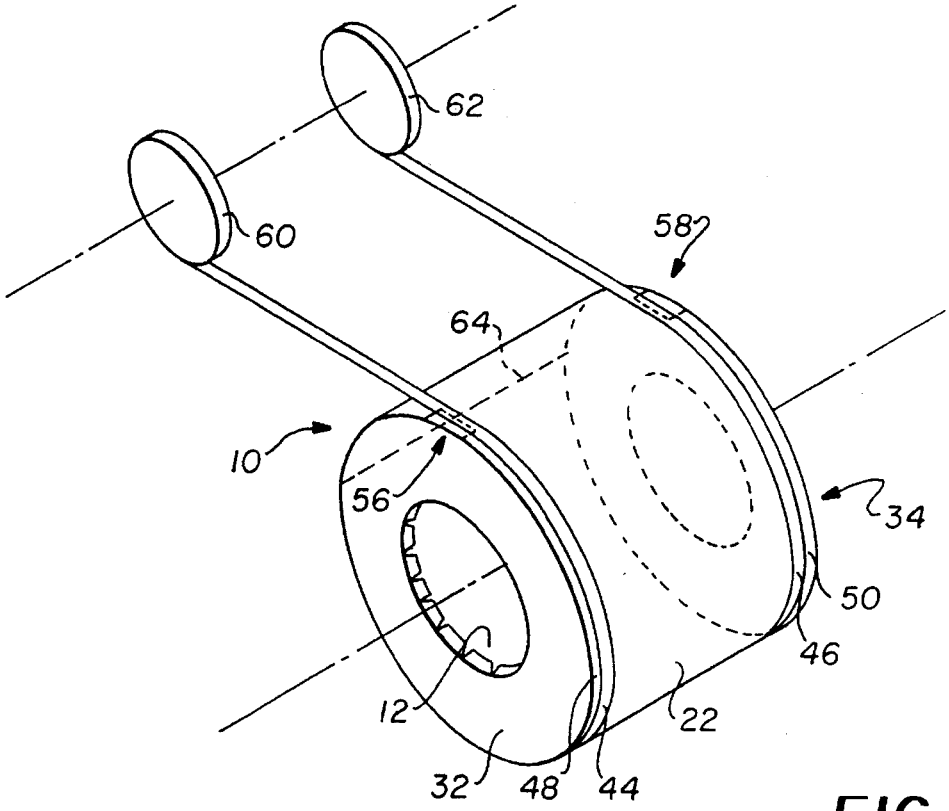

Referring simultaneously to FIGS. 1 to 3, the salient features of our invention can be understood. A roll 10 of light-sensitive web material includes a central, typically flangeless, hollow core 12 having opposite ends and a length approximately equal to the width of a length 14 of such web material. Length 14 is wound onto core 12; so that, in the familiar manner, the wound roll 10 has opposite end surfaces 16, 18. The leading end 20 of length 14 is joined to a flexible, opaque leader 22 having a trailing end 24, and a width approximately equal to the length of core 12. To prevent inadvertent exposure of the product, the length of leader 22 preferably is at least as long as one and one-eighth times the maximum circumference of roll 10. Extra length may be included for grasping by the customer. Leader 22 may be made from various opaque materials, such as polyester containing carbon black or rubber-modified high density polyethylene containing carbon black. A suitable carbon black content would be in the range of 3 to 8% by weight. A thickness for leader 22 in the range of 0.076 to 0.381 mm will ensure suitable tensile strength. A strip 26 of tape may be used to join ends 20, 24; however, other means of attachment, such as ultrasonic or heat splicing, may be used. Leader 22 has longitudinally extended lateral edges 28, 30.

A pair of flexible opaque end disks 32, 34 cover end surfaces 16, 18. Each disk includes a central portion 36 with a hole 38 somewhat smaller in diameter than an internal diameter of core 12. In one embodiment, end disks 32, 34 are made from an opaque but thin and flexible material which has adequate tensile strength to resist tearing when the completed package is opened. In another embodiment, end disks 32, 34 are made from an opaque but thin and flexible material which has a reduced tensile strength to permit circumferential tearing of the end disks when the completed package is opened. Optionally and particularly in embodiments using end disks made of a reduced tensile strength material, a plurality of radial cuts 40 may be extended radially outwardly from hole 38 through the thickness of the disk, to facilitate attachment to the core. In the familiar manner, the portions of the disks between cuts 40 would be folded into core 12 and secured there using any suitable adhesive, as indicated in FIG. 3. A peripheral portion 42 of each end disk extends somewhat beyond the radius of roll 10, preferably between 8 and 16 mm, to allow for some variation in the diameter of roll 10. In the assembled package, peripheral portions 42 are folded over the circumferential edges of the first convolution of leader 22 onto the outer surface of leader 22, as seen in FIG. 3.

End disks 32, 34 may be made from any suitable opaque, thin gauge material having, depending on the application, adequate tensile strength to resist, or permit, tearing when the package is opened, but only modest stiffness. That is, in addition to being opaque and having a certain tensile strength, the material should be flimsy to minimize interference with the product or adjacent structure during opening of the package or unwinding of the roll. One suitable material which resists tearing would be a lamination including an outer layer of 0.025 mm thick white, opaque, high density polyethylene-low density polyethylene blend extrudate; a second layer of 0.076 mm thick linear low density polyethylene film containing carbon black; and a third layer comprising a coextrusion of 4 pound ethylene vinyl acetate and 16 pound Surlyn extrudate, approximately 0.032 mm thick. The overall thickness of the lamination may be in the range of 0.051 to 0.127 mm to ensure that the end disks have adequate tensile strength to resist tearing when the leader is removed but also are suitably flimsy. The carbon black content may be as for leader 22. In use, the inner layer would face roll 10. Other suitable materials for end disks 32, 34 include any suitable plastic film or lamination which could include high density polyethylene, polypropylene, Cellophane, Nylon, polyester and various combinations thereof which are opaque, flimsy and have adequate tensile strength to resist or permit tearing, as desired, during use in the package according to our invention.

A pair of elongated strips of adhesive tape 44, 46 are used to secure peripheral portions 42 after the peripheral portions have been folded over onto the first convolution of leader 22 to form folded-over portions 48, 50. The strips are wrapped around (a) the outer surfaces of folded-over portions 48, 50 and (b) the outer surfaces of marginal portions 52, 54 of a first convolution of leader 22. For ease of illustration, marginal portions 52, 54 are shown as shorter in FIG. 1 than in FIG. 2. Preferably, the strips extend over folded-over portions 48, 50 to locations not axially beyond the circumferential edges of the first convolution of leader 22. Adhesive strips 44, 46 preferably begin at a distance from trailing end 24 of about one-eighth the diameter of roll 10. The adhesive strips extend along marginal portions 52, 54 for a distance appropriate to provide somewhat more than one convolution around roll 10. At a distance of about one and one-eighth times the circumference of roll 10 along leader 22, a pair of inwardly extended features, such as notches or recesses 56, 58, are provided through lateral edges 28, 30, toward the centerline of the leader, and into marginal portions 52, 54. Each feature has a transverse width somewhat wider than folded-over portions 48, 50 of end disks 32, 34. Rather than notches or recesses, the features may comprise a short cut or series of cuts. To prevent entry of light through the recesses, adhesive strips 44, 46 preferably extend axially somewhat beyond recesses 56, 58 in the completed package, as seen in FIG. 3. While continuous strips of adhesive tape 44, 46 are preferred, those skilled in the art will appreciate that several shorter abutted or intermittent lengths could be used without departing from our invention, so long as any spacing between the shorter lengths does not permit entry of light. Also, particularly for rolls having rather narrow widths, a single strip of adhesive tape may be used for both folded-over portions, rather than one strip for each portion.

Adhesive strips 44, 46 must be opaque and should have a transverse width of about twice the width of folded-over portions 48, 50, about half of this width being adhered to the folded-over portions and half, to the leader. Adhesive strips 44, 46 preferably have the property of adhering well to leader 22 and to folded-over portions 48, 50. Those skilled in the art will appreciate that any adhesive tape having these characteristics will be appropriate, such as Product No. 471, a black, opaque vinyl tape made by 3M Company.

To assemble the package according to our invention, length 14 is wound onto core 12. Preferably after winding of length 14, end disks 32, 34 are attached to core 12. Leader 22 is attached to the lead end of length 14. One and one-eighth convolutions of leader 22 are then wound around roll 10. Then, peripheral portions 42 are folded over onto leader 22 to form folded-over portions 48, 50 as shown in FIGS. 2 and 3. As shown in FIG. 3, folded-over portions 48, 50 pass through recesses 56, 58 to permit leader 22 to move from beneath to above portions 48, 50. The folding over may be done manually or using any convenient apparatus, such as that shown in U.S. Pat. No. 4,137,690. Tape strips 44, 46 are then fed from suitable spools 60, 62 and wrapped around the package, taking care to cover both portions 48, 50 and part of marginal portions 52, 54. A lead end 64 of leader 22, illustrated in phantom, may be secured to the roll in any convenient manner, such as by means of tape strips, to provide the completed light-tight package according to our invention.

When the completed package is opened in a cassette or cooperating apparatus, leader 22 is pulled away from the roll. Typically, core 12 is supported by means not illustrated which engage the core to permit the package to rotate as the leader is removed. In a cassette, the leader would be threaded through an exit slot and the cassette would be closed. Pulling on the leader eventually subjects the bonds between adhesive strips 44, 46, leader 22 and folded-over portions 48, 50 to forces which would tend to separate the adhesive bonds, tear the leader, tear the end disks, or all of these. In the case where end disks 32, 34 are made from material which resists tearing, the forces acting to peel or separate strips 44, 46 from folded-over portions 48, 50 are greater than the forces acting to separate strips 44, 46 from leader 22. As a result, strips 44, 46 peel free from folded-over portions 48, 50 and exit the cassette with leader 22. In the case where end disks 32, 34 are made from material which permits tearing, strips 44,46 adhere to folded-over portions 48, 50 which tear free from the remainder of the end disks and exit the cassette with the leader. When the leader has been completely pulled away, the operator removes tape strip 26, discards the leader and threads leading end 20 into the cooperating apparatus, not illustrated.

Parts List

10 . . . roll of web of light-sensitive material
12 . . . core with opposite ends and length
14 . . . length of web on core, width equal to length of core
16, 18 . . . opposite end surfaces of roll as-wound
20 . . . leading end of length 14
22 . . . flexible, opaque leader, width equal to length of core
24 . . . trailing end of 22
26 . . . tape to attach 24 to 20
28, 30 . . . lateral edges of 22
32, 34 . . . flexible opaque end disks
36 . . . central portion of 32, 34
38 . . . hole through 32, 34
40 . . . radial cuts surrounding 38
42 . . . peripheral portion of 32, 34
44, 46 . . . elongated adhesive elements
48, 50 . . . folded-over portions
52, 54 . . . lateral marginal portions of 22
56, 58 . . . recesses in 52, 54
60, 62 . . . spools of tape
64 . . . lead end of 22

While our invention has been shown and described with reference to particular embodiments thereof, those skilled in the art will understand that other variations in form and detail may be made without departing from the scope and spirit of our invention.

Having thus described our invention in sufficient detail to enable those skilled in the art to make and use it, we claim as new and desire to secure Letters Patent for:

1. A light-tight package for a roll of light-sensitive web material, the roll including a core with opposite ends and a length of the web wound about the core; the roll having end surfaces at the opposite ends of the core and the length having a first width and a leading end; the package including a flexible opaque leader wound about the roll through at least a first convolution, the leader having a trailing end attached to the leading end, a second width substantially equal to the first width, an outer surface, a length greater than a circumference of the roll and opposite lateral edges separated by the second width; pair of flexible opaque end disks for covering the end surfaces, a central portion of each end disk being attached to the core and a peripheral portion of each end disk being folded over a circumferential edge of the first convolution of the leader, each folded over portion having an outer surface and a circumferential edge, wherein the improvement comprises:

at least one strip of adhesive tape, the strip being adhered to the outer surface of each of the folded over peripheral portions and to the outer surface of the leader.

2. A package according to claim 1, wherein the at least one strip of adhesive tape extends over the folded over portions to locations not axially beyond the circumferential edges of the leader.

3. A package according to claim 1, wherein there are two strips of the adhesive tape, one for each folded over peripheral portion.

4. A package according to claim 1, wherein the leader has a length greater than one and one-eighth times the circumference of the roll.

5. A package according to claim 4, wherein each lateral edge of the leader includes a feature extending inwardly toward a center line of the leader, the features being spaced from the trailing end by a distance substantially equal to one and one-eighth times the circumference of the roll, the features providing clearance for any further convolution of the leader to pass the folded over peripheral portions of the end disks.

6. A package according to claim 1, wherein the at least one strip of adhesive tape is continuous.

7. A package according to claim 1, wherein:

the end disks being made from a material having sufficient tensile strength to resist tearing before the at least one strip releases the folded-over portions, whereby upon unrolling of the package by pulling the leader, the end disks release from the at least one strip without tearing and the at least one strip moves away from the roll with the leader.

8. A package according to claim 1, wherein:

the end disks being made from a material having sufficient tensile strength to allow tearing before the at least one strip releases the folded-over portions, whereby upon unrolling of the package by pulling the leader, the end disks tear circumferentially and the at least one strip and the torn away, folded over portions move away from the roll with the leader.

* * * * *